United States Patent [19]

Masuda

[11] Patent Number: 4,843,738

[45] Date of Patent: Jul. 4, 1989

[54] SHOE INSOLE

[75] Inventor: Isamu Masuda, Fukuoka, Japan

[73] Assignee: Nihonkenkozoshinkenkyukai Co., Ltd., Fukuoka, Japan

[21] Appl. No.: 150,368

[22] PCT Filed: Nov. 6, 1986

[86] PCT No.: PCT/JP86/00564

§ 371 Date: Dec. 23, 1987

§ 102(e) Date: Dec. 23, 1987

[87] PCT Pub. No.: WO88/03371

PCT Pub. Date: May 19, 1988

[51] Int. Cl.[4] ..... A43B 13/38

[52] U.S. Cl. ..... 36/44; 36/43; 128/383

[58] Field of Search ..... 36/11.5, 43, 44; 128/382, 383

[56] References Cited

U.S. PATENT DOCUMENTS

| | | | |
|---|---|---|---|
| 2,307,416 | 1/1943 | Margolin | 36/43 |
| 4,033,054 | 7/1977 | Fukuoka | 36/11.5 |
| 4,223,458 | 9/1980 | Kihara | 36/44 |
| 4,727,661 | 3/1988 | Kuhn | 36/43 |

FOREIGN PATENT DOCUMENTS

| | | | |
|---|---|---|---|
| 20154 | 2/1977 | Japan | 36/25 R |
| 146149 | 11/1979 | Japan | 36/43 |
| 1161073 | 6/1985 | U.S.S.R. | 36/44 |
| 1299560 | 3/1987 | U.S.S.R. | 36/44 |

*Primary Examiner*—Werner H. Schroeder
*Assistant Examiner*—D. Biefeld
*Attorney, Agent, or Firm*—Jordan and Hamburg

[57] ABSTRACT

A shoe insole includes a magnetized insole body formed of a mixture including rubber and magnetic poweder, the body having a first and second generally flat surface, and reinforcing sheets juxtaposed to each of the first and second surfaes. The insole has projections projecting from at least one of the surfaces, the projections being formed integrally with the body, and at least one of the sheets having projecting sheet portions projecting into such projections.

9 Claims, 3 Drawing Sheets

SHOE INSOLE

DESCRIPTION

1. Technical Field

The present invention relates to an inner sole used for inserting into shoes, more specifically, it relates to a shoe insole as a health instrument for promoting health by applying a line of magnetic force and a biasing stimulus to the sole of a foot.

2. Background of the Art

Conventionally, a shoe insole, as shown in FIG. 6, includes a rubber sheet 22 having a plurality of projections 21 fixed to the plantar arch of a leather insole body 20. The rubber sheet 22 is formed by laying permanent magnet grains in each projection 21, and its periphery is inserted into a groove 23 provided in the insole body 20 so as to be fixed integrally.

However, in the case of such insole, since the magnetized portion is present only partly in the insole 20, a line of magnetic force can not be applied entirely throughout the sole, thus it is difficult to obtain an effective magnetic treatment. Also, since the rubber sheet 22 is not strong physically, when the bending stress or the like has occurred in use, considerable difficulty was encountered as regards durability such as becoming unusable by cracks and tears produced on the rubber sheet 22.

In order to solve these problems, the inventor has developed a construction of an insole which includes pressing and magnetizing a mixture of rubber and magnetic powder, and laying a reinforcing sheet material within the center of the insole body. According to the construction, the line of magnetic force can be applied entirely throughout the sole, and tears of the insole due to bending stress can be prevented, thus improving the durability thereof.

However, in such improvement as mentioned above, though the reinforcing sheet material functions effectively to prevent tears and cracks of the insole, cracks occurring on its surfaces can be hardly prevented and a sufficient physical strength is difficult to obtain. Besides, when the projections are projected integrally on the surfaces of the insole, cracks occurring on the base portion of the projection will cause it to come off, consequently the treatment effect by the biasing stimulus will be reduced considerably.

It is an object of the present invention to provide a shoe insole which has solved the above problems by devising a method of laying the reinforcing sheet material into the insole body.

DISCLOSURE OF THE INVENTION

A shoe insole according to the present invention comprises an insole body which is formed by pressing and magnetizing a mixture of rubber and magnetic powder and which is provided with projections projected integrally thereon.

In the shoe insole according to the present invention, two sheets of reinforcing material which are in conformity with the shape of the insole body, are laid within the insole body and each reinforcing sheet material is positioned along the vicinity of its surfaces.

According to the present invention, since the insole body is magnetized entirely, a line of magnetic force can be applied to the entire sole of a foot, thus the magnetic treatment effect can be improved. Also, since the two sheets of reinforcing material are laid within the insole body, cracks and tears caused by bending stress can be prevented completely, improving the durability of the insole body. Moreover, since the two sheets of reinforcing material are positioned along the surfaces of the insole body, the occurrence of cracks thereon can be also prevented, thus the physical strength is improved and falling of the projection caused by the cracks occurring at the base portion of the projection is prevented, so that there is no possibility of reducing the treatment effect by the biasing force.

BEST MODE FOR CARRYING OUT THE INVENTION

Figure 1:
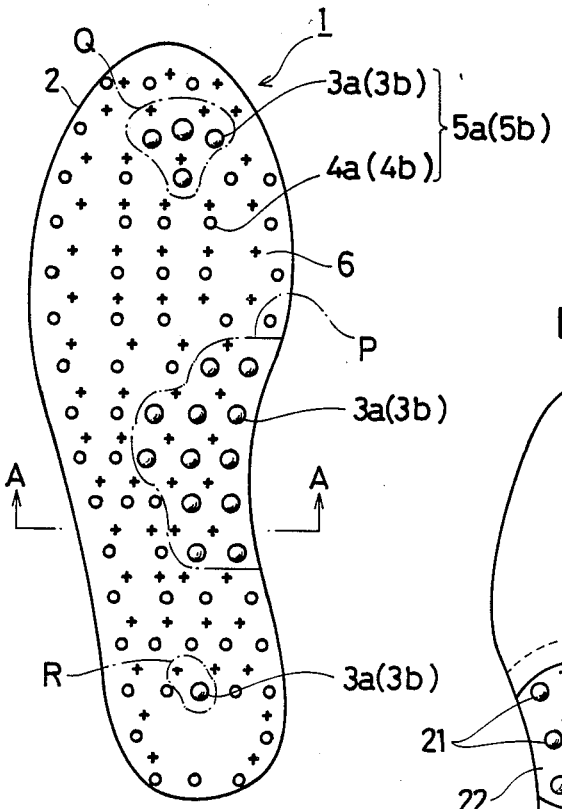
FIG. 1 is a plan view showing a shoe insole according to one embodiment of the present invention.
Figure 6:
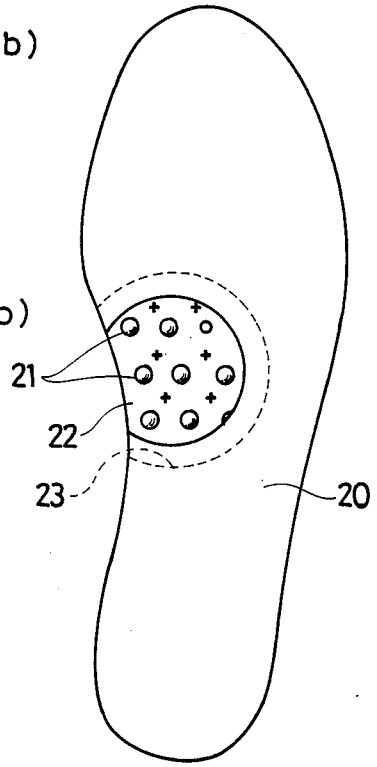
FIG. 6 is a plan view showing a conventional shoe insole.
Figure 2:
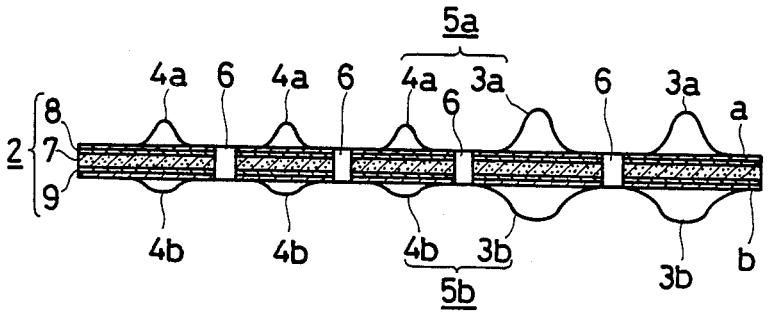
FIG. 2 is a vertical sectional view of a shoe insole taken along the line A—A of FIG. 1.

FIGS. 1 and 2 show a shoe insole 1 according to one embodiment of the present invention, in which FIG. 1 shows an external view of the embodiment and FIG. 2 shows an internal structure thereof.

In the shoe insole 1 shown in the drawing, a group of projections 5*a*, 5*b* which include large projections 3*a*, 3*b* and small projections 4*a*, 4*b*, are formed integrally on both surfaces (hereinafter, for convenience' sake, the surface is indicated by a and the reverse side is indicated by b of the thin liner body 2 having a shape of the sole of a foot, and a plurality of air holes 6 (shown by a + in FIG. 1) are formed through the entire surface of the insole body 2.

A group of projections 5*a*, 5*b* on each surface are selectively used at the user's option and when the insole 1 is inserted into the shoes, the projections on one side touch the sole of a foot to function for treatment, and those on the other side touch the sole of a shoe to form air paths between the insole body 2. In order to apply various different biasing stimuli to the human body, the large and small projections 3*a* and 4*a* of projection group 5*a* are formed into the sharp cone-shaped tips, and the large projections 3*b* and small projections 4*b* of the other projection group 5*b* are formed into the flat and round cone-shaped tips. The large projections 3*a*, 3*b* among each projection are arranged respectively in a large number at the plantar arch P, four at the finger joints Q and one at the heel R, and the small projections 4*a*, 4*b* are arranged entirely on the other portions uniformly.

Figure 3:
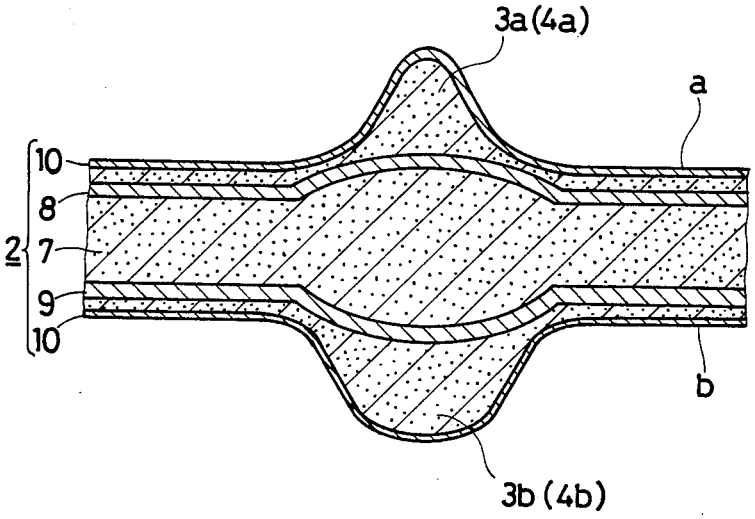
FIG. 3 is an enlarged sectional view showing the projected portion of an insole body.

The insole body 2 is, as shown in FIG. 3, constructed such that two sheets of flexible reinforcing material 8, 9 are laid within a rubber magnet plate 7, whose entire surfaces are formed with a protective coat 10 with a polyurethane coating and the like.

The rubber magnet plate 7 mentioned above is formed of a mixture of synthetic rubber such as NBR rubber (nitrobutadiene rubber) and a magnetic powder such as ferrite as a main raw material, and N-pole and S-pole are magnetized respectively on the a side and b side, with a flux density of about 400 to 600 gauss at each projection.

Each sheet of reinforcing material 8, 9 is shaped to conform with the shape of the insole body 2 and consists of a cotton or nylon fabric. One reinforcing sheet material 8 is positioned along the vicinity of the surface a and the other reinforcing sheet material 9 is positioned along the vicinity of the reverse side b of the insole body 2, and each one is projected into the thick portion of the projection at each position of the large projections *3a, 3b* and the small projections *4a, 4b*.

Figure 4:
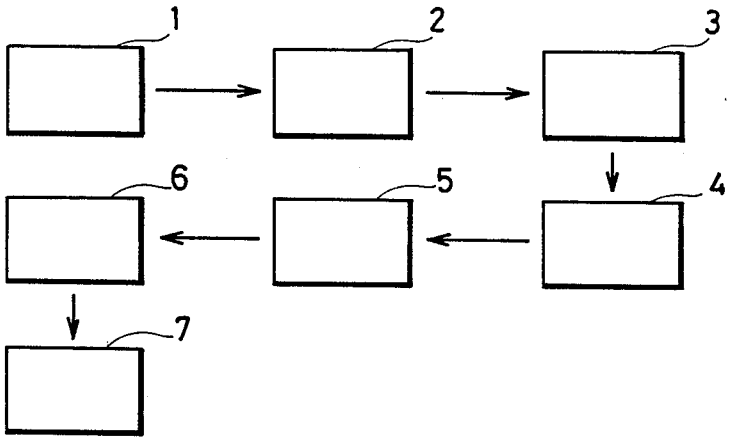
FIG. 4 is a flow sheet showing a manufacturing process of a shoe insole.

FIG. 4 specifically shows a method of manufacturing the aforementioned insole body 2.

The first process 1 is for preparing raw materials of the rubber magnet plate 7, whereby synthetic rubber such as NBR rubber and a ferrite powder are mixed at the rate of 1:15 by weight, and to the mixture there is added with a cross-linking agent, zinc oxide, sulphur, curing agent, softener (e.g. DOP—dioctyl phthalate), etc. and kneaded.

The following process step 2 is for forming the rubber magnet plate 7, whereby the raw materials prepared are compressed by a roller and formed into a plate having a uniform thickness, then cut into the prescribed size.

Figure 5:
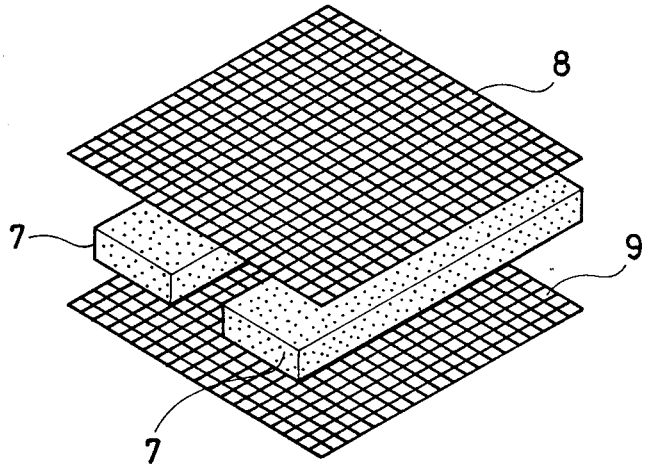
FIG. 5 is a perspective view for illustrating one process in a manufacturing process of a shoe insole.

In the next process step 3, as shown in FIG. 5, the two sheets of reinforcing material 8, 9 are positioned to face each other and the rubber magnet plates 7, 7, are clamped and are all pressed together with a hot plate mold for a fixed time while heated. The temperature at this time is, for example, around 135° C. and the pressing time is 3 to 4 minutes. In the heating and pressing process step, the projections *5a, 5b* are formed on the both surfaces and each reinforcing sheet material 8, 9 is laid in the vicinity of both surfaces within the rubber magnet plate 7. Besides, at each position of the large projections *3a, 3b* and the small projections *4a, 4b*, each reinforcing sheet material 8, 9 enters into the thick portion of the projection and functions effectively to reinforce the projection.

In the case of this embodiment, a nylon fiber consisting of polycapramide (structural formula: $[NH(CH_2)_5CO]_n$) and treated with an adhesion treating agent comprising a mixture of condensation polymer of resorcinol-formaldehyde, copolymer of butadiene-styrene vinyl-pyridine and copolymer of butadiene styrene is used as the reinforcing sheet material 8, 9, and when it is heated and pressed together with the rubber magnet plate 7, the adhesion treating agent is fused to bond the reinforcing sheet material 8, 9 with the rubber magnet plate 7 rigidly in one body.

In the following process step 4, extracting the formed body and drilling the air holes 6 therein are conducted simultaneously to complete the external shape of the insole body 2, which is, in the process step 5, coated with an elastic polyurethane 2 liquid resin coating entirely on both surfaces, thereby forming the protective coat 10 having a superb wear-resistance.

In the next process 6, the entire insole body 2 is treated for magnetization, whereby an N-pole is magnetized on the surface a and an S-pole is magnetized on the reverse side b. In the case of this embodiment, by the magnetization in the process a flux density of 550 gauss is given to the large projections *3a, 3b*, 400 gauss at the small projections *4a, 4b* and 180 gauss at the other plane portions.

In the last process step 7, other treatments are conducted to complete the product.

In the embodiment mentioned hereinbefore, though two sheets of reinforcing material 8, 9 are laid at the prescribed positions within the rubber magnet plate 7, it will be appreciated that an additional reinforcing sheet material may be inserted, for example, between the reinforcing sheet materials 8, 9 when necessary.

INDUSTRIAL APPLICABILITY

In using the shoe insole 1, when it is inserted into a shoe with the reverse side b facing the sole of the shoe, since air paths are formed between the sole of the shoe and the insole 1 by the group of projections *5b*, in cooperation with the air holes 6, evaporation of sweating is accelerated, functioning effectively to prevent stuffiness. When placing a foot on the insole 1, the group of projections *5a* on the surface side a contact the sole of the foot and a strong biasing stimulus is applied entirely on the sole by each of large and small projections *3a, 4a*, and at the same time, a line of magnetic force from the rubber magnet plate 7 functions effectively. When an excessive biasing force is applied, the insole 1 can be reversed to select the slighter one by the projection group *5b* on the reverse side b.

When bending stress occurs on the insole 1 while wearing or taking off shoes or walking, since two sheets of reinforcing material 8, 9 are laid within the insole body 2, cracks and tears due to the bending stress may be prevented completely.

Besides, since the two sheets of reinforcing material 8, 9 are positioned along the surface side a and reverse side b of the insole body 2, and in addition, each of the reinforcing sheet material 8, 9 is bonded rigidly with the rubber magnet plate 7 by the bonding force of an adhesion treating agent, the occurence of cracks occurred on both surfaces of the insole body 2 can be also prevented completely.

In particular, the cracks can hardly occur at the base portions of the large projections *3a, 3b* and the small projections *4a, 4b*, which are prevented from coming off in use, besides, since each reinforcing sheet material 8, 9 is inserted into the thick portion of each projection, preventive function against the falling of the projections may be greatly accelerated. Furthermore, both surfaces of the insole body 2 are coated entirely with the protective coat 10, so that a high wear-resistance with the physical strength which is sufficiently endurable to ordinary use can be obtained.

I claim:

1. A shoe insole comprising a magnetized insole body formed of a mixture comprising rubber and magnetic powder, said body having a first and a second generally flat surface, and reinforcing sheets juxtaposed to each of said first and second surfaces, said insole having projections projecting from at least one of said surfaces, said projections being formed integrally with said body, at least one of said sheets having projecting sheet portions projecting into said projections.

2. A shoe insole according to claim 1, wherein said insole has projections projecting from both of said surfaces, and both of said sheets having projecting sheet portions projecting into said projections.

3. A shoe insole according to claim 1, wherein said rubber comprises nitrobutadiene rubber and said magnetic powder comprises ferrite powder.

4. A shoe insole according to claim 1 further comprising an outer protective coating on said first and second surfaces of said body, said coating comprising a polyurethane.

5. A shoe insole according to claim 1 further comprising a plurality of through holes in said body.

6. A shoe insole according to claim 1, wherein said projections comprise a plurality of first projections of one size and a plurality of second projections of a larger size.

7. A shoe insole according to claim 6, wherein the insole has a plantar arch area, a toe joint area, a heel area, and a remainder area which constitutes the remainder area outside of said plantar arch area, said toe joint area, and said heel area; said plantar arch area, said toe joint area and said heel area having at least one of said second larger size projections, said remainder area having projections of said first size.

8. A shoe insole according to claim 1, wherein said reinforcing sheets are embedded and bonded together with said body.

9. A shoe insole according to claim 8, wherein said reinforcing sheets comprise a fabric of nylon fibers.

* * * * *